United States Patent [19]

Sukimoto et al.

[11] Patent Number: 4,805,435

[45] Date of Patent: Feb. 21, 1989

[54] METHOD FOR PRODUCING ALUMINUM DRUMS HAVING HIGHLY SMOOTH SURFACE

[75] Inventors: Minobu Sukimoto; Hiromune Chuma, both of Oyamashi; Teruo Tachi, Kasamashi, all of Japan

[73] Assignee: Showa Aluminum Kabushiki Kaisha, Japan

[21] Appl. No.: 148,981

[22] Filed: Jan. 27, 1988

[30] Foreign Application Priority Data

Jan. 29, 1987 [JP] Japan ..... 62-19323

[51] Int. Cl.[4] ..... B21C 1/24

[52] U.S. Cl. ..... 72/283

[58] Field of Search ..... 72/283, 276, 274, 467, 72/256

[56] References Cited

U.S. PATENT DOCUMENTS

| | | | |
|---|---|---|---|
| 2,355,734 | 8/1944 | Katz | 72/283 |
| 3,798,943 | 3/1974 | Benteler et al. | 72/283 |
| 3,847,001 | 11/1974 | Thamasett | 72/283 |
| 4,161,112 | 7/1979 | Stump | 72/283 |

*Primary Examiner*—Daniel C. Crane

[57] ABSTRACT

A method for producing aluminum drums having highly smooth surfaces, the method including two steps; the preparation of an aluminum pipe by extrusion, and the drawing of the pipe through a die unit, wherein the die unit comprises a die and a plug, the die having an approach angle of 45° to 75° C. and the plug having an approach angle of 10° to 20°.

6 Claims, 1 Drawing Sheet

METHOD FOR PRODUCING ALUMINUM DRUMS HAVING HIGHLY SMOOTH SURFACE

BACKGROUND OF THE INVENTION

1. Field of the Invention

The present invention relates to a method for producing an aluminum drum adapted for use in electronic copying machines, laser beam printers and magnetic roller sleeves, and more particularly to an aluminum drum having a highly smooth surface. The term "aluminum" as herein employed includes aluminum alloys.

2. Description of the Prior Art

An electronic copy machine and a laser beam printer use aluminum drums for exposing a film or the like to light thereon. In this case the drum must be as smooth as not larger than 0.8 to 1 μm Rmax. To produce aluminum drums having such highly smooth surfaces there is one proposal; according to it an aluminum pipe is first produced by extrusion, and then the pipe is drawn, during which if necessary correction is made on the dimensional precision and profile.

The pipe is drawn through a special die unit which consists of a die and a plug, wherein the die includes a die bore adapted to allow an aluminum pipe to pass through. The die bore diverges at a certain angle outward, and the stress to which the pipe is subjected during drawing depends on the angle of the die bore. It has been taught that to minimize the stress the angle should be adjusted to 16° to 20°.

However the surfacial smoothness of the pipe does not reach the degree that the drum can be used as an exposing drum in the electronic copying machines. Therefore it becomes necessary to polish the surface of the pipe so as to reach the required degree of smoothness.

In this way the known process requires two steps, thereby leading to the increased production cost. In general the industry of electronic copying machines is very competitive with so many manufacturers, and in order to win the competition the reduced price as well as the quality of the machines are great concerns for them.

OBJECTS AND SUMMARY OF THE INVENTION

The present invention aims at solving the problems pointed out above, and has for its object to provide a method for producing an aluminum drum having a highly smooth surface in a single process.

Another object of the present invention is to provide a method for producing an aluminum drum having a highly smooth surface economically.

Other objects and advantages of the present invention will become more apparent from the following detailed description, when taken in conjunction with the accompanying drawings which show, for the purpose of illustration only, one embodiment in accordance with the present invention.

According to the present invention there is provided a method for producing aluminum drums having highly smooth surfaces, the method comprising: preparing an aluminum pipe by extrusion; and drawing the pipe through a die unit, wherein the die unit comprises a die and a plug, the die having an approach angle of 45° to 75° and the plug having an approach angle of 10° to 20°.

DETAILED DESCRIPTION OF THE PREFERRED EMBODIMENT

Figure 1:
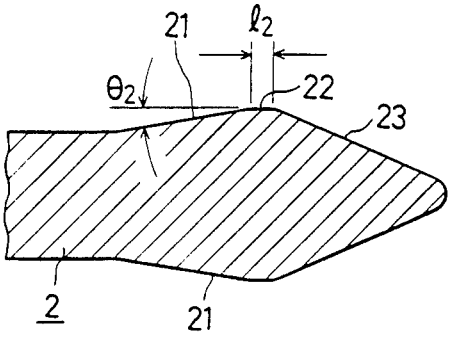
FIG. 1 is a vertical cross-section through a plug on an enlarged scale.
Figure 2:
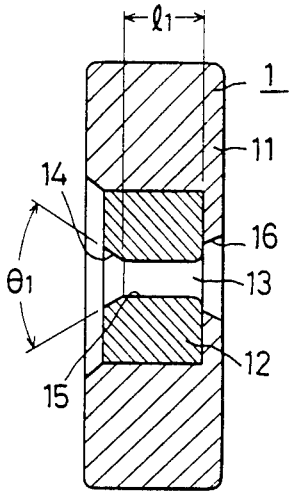
FIG. 2 is a vertical cross-section through a die having a die bore.

First, an aluminum pipe is prepared by the known extruding method; more particularly, the aluminum is melted and cast into billets, which are extruded into pipes through an outlet of the vessel as a molten aluminum. The kinds of aluminum used can be various; in light of the good workability A3003 type is preferred.

The extruded pipes are cut to a desired length, and then they are subjected to drawing with the use of a die unit 4, which consists of a die and a plug. Now, the drawing die unit will be described in greater detail:

There are provided a die 1 and a plug 2, the die 1 including a block 11 and a die piece 12 fitted in the block 11, wherein the die piece 12 is made of die metal, super hard alloy or ceramics, and has a die hole 13 produced in the center. The die hole 13 includes an approach section 14, a bearing section 15 and a relief section 16. The approach section 14 has an inwardly converged diameter whereas the bearing section 15 has a constant diameter. The die 1 has an approach angle $\theta_1$ adjustable to 45° to 75°. If it is small than 45° a rough drum surface will result, thereby making the drums inapplicable to the film exposure use. However if it exceeds 75° seizure is likely to occur, thereby impairing the surface of drum. The optimum range is 60° to 70°. The length $l_1$ of the bearing section 15 can be selected as desired but experiments have demonstrated that when it is set to 15 to 40 mm a high quality of drum results. If the length of the bearing section 15 is small than 15 mm the drum is likely to be dimensionally unstable, that is, uneven in its circumference and thickness. However if it exceeds 40 mm, seisure is likely to occur, thereby impairing the drum surface.

The plug 2 has an approach section 21, a bearing section 22 and a relief section 2 corresponding to those of the die 1. Hereinafter those of the plug 2 will be referred to as second approach section, second bearing section and second relief section, respectively, whereas those of the die 1 will be as the first approach section 14, the first bearing section 15 and the first relief section 16. The approach angle $\theta_2$ of the plug is set to 10° to 20°. The expression "approach angle of the plug" as herein employed refers to the angle between the approach section 21 and the bearing section 22. If this angle is small than 10° a rough surface of the drum results, and if it exceeds 20° the drum is likely to be uneven in its circumference and thickness. Preferably the approach angle of the plug 2 is set to 13° to 15°. The length $l_2$ of the second bearing section 22 can be various but the optimum range is 0.5 to 3.0 mm. If it is smaller than 0.5 mm it becomes difficult to determine the dimension of the drum. However if it exceeds 3.0 mm seisure is likely to occur, thereby impairing the producing surfacial smoothness of the drum. The reference numeral 3 denotes a stem for supporting and fixing the plug 2. The inside diameters of the first and second bearing sections depend upon the diameters and wall thickness of the drums to be produced.

Figure 3:
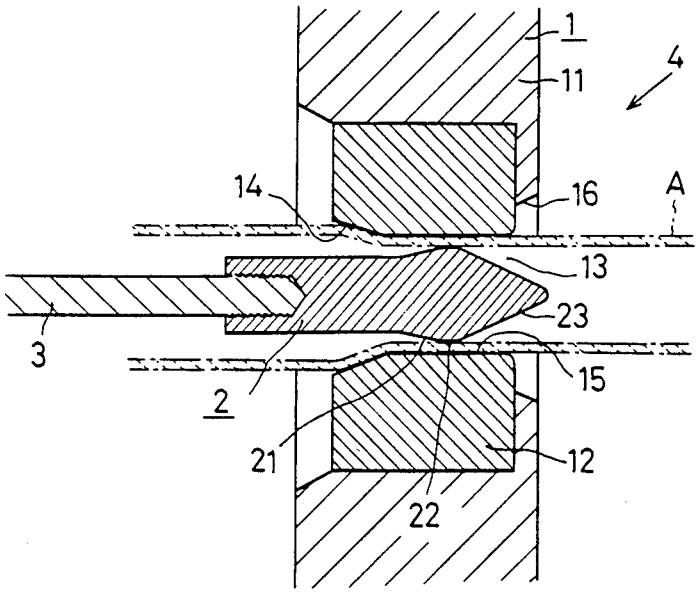
FIG. 3 is a vertical cross-section showing a coworking state of the plug and die.

The die 1 and the plug 2 are united into the die unit 4 as shown in FIG. 3. The plug 2 is inserted into the die hole 13 of the die 1, and stays with its second bearing section 22 positioning at a central portion of the first bearing section 15 of the die member 12. In this case there is provided such a space therebetween as to allow an extruding aluminum pipe (A) to pass through. The aluminum pipe (A) is drawn through the die unit 4 as indicated by the phantom line in FIG. 3. The pipe is drawn from left to right in FIG. 3, thereby causing the pipe to have a reduced diameter. When necessary, the drawing is repeated until a desired diameter is achieved. In drawing the pipe the approach angles $\theta_1$ and $\theta_2$ may be respectively set to 45° to 75° and 10° to 20° throughout the process or may be set thereto only for the last drawing. The lubricant used in drawing can be of any kinds and viscosity.

The illustrated embodiment has a stem 3 for fixing the plug 2 in the die bore 13 but it is possible to employ a floating system without the use of any fixing member.

The drawn pipe is cut into drums, and cleansed to remove the oily elements staying on the surface thereof. Unlike the known method no extra step is required for polishing the surfaces of the extruded pipes. This enhances the production efficiency and leads to the reduced cost.

The present invention will be better understood from the following example:

EXAMPLE

An aluminum alloy (A3003 type) billet was extruded into several pipes in the known manner. Each pipe had an outside diameter of 20 mm, an inside diameter of 17 mm and a thickness of 1.5 mm (tempering: H112). Then they were subjected to a first drawing, so that each had an reduced outside diameter of 17.5 mm, a reduced inside diameter of 15.3 mm and a reduced thickness of 1.1 mm. The die unit 4 employed was the one shown in FIG. 3. The approach angle $\theta_1$ of the die was 60° and the length $\theta_1$ of the bearing 15 was 20 mm. The approach angle $\theta_2$ of the plug 2 was 13° and the length $l_2$ of the bearing 22 was 1.2 mm. The die and plug used was made of super hard alloy.

The second drawing process was applied to each of the pipes with the use of the same die unit but at different approach angles and different lengths of the bearings. The resulting drums had an outside diameter of 16 mm, an inside diameter of 14.4 mm and a thickness of 0.8 mm. A lubricant of the same kind was used throughout the first and second drawing processes. The surfacial roughness of each drum is shown in Table 1:

TABLE 1

| Die Unit | | Die | | Plug | | Roughness |
|---|---|---|---|---|---|---|
| No. | | $\theta_1$ (°) | $l_1$ (mm) | $\theta_2$ (°) | $l_2$ (mm) | Rmax (μm) |
| Practising of Invention | 1 | 48 | 20 | 13 | 1.2 | 1.0 |
| | 2 | 50 | 20 | 19 | 1.2 | 0.8 |
| | 3 | 57 | 20 | 15 | 1.2 | 0.3 |
| | 4 | 68 | 18 | 12 | 0.8 | 0.5 |
| | 5 | 73 | 24 | 16 | 1.5 | 0.8 |
| Comparative Method | 6 | 42 | 20 | 8 | 1.2 | 3.0 |
| | 7 | 25 | 20 | 15 | 1.2 | 5.0 |
| | 8 | 19 | 32 | 8 | 0.4 | 6.0 |
| | 9 | 50 | 20 | 7 | 1.2 | 2.0 |

As is evident from Table 1 the aluminum drums produced in accordance with the present invention have highly smooth surfaces as compared with those produced at the approach angles of the die and plug, and the lengths of bearing sections outside the specified ranges thereof under the present invention.

What is claimed is:

1. A method for producing aluminum drums having highly smooth surfaces from aluminum pipe, the method comprising: preparing an aluminum pipe by extrusion; and drawing the pipe through a die unit, wherein the die unit comprises a die including a first approach section having an inwardly reduced diameter and a first bearing section having a constant diameter, and a plug including a second approach section and a second bearing section, said second approach section having an increasing diameter towards the second bearing section and the second bearing section having a constant diameter over a predetermined length, wherein the first approach section is open towards the plug at an approach angle of 45° to 75° and wherein an approach angle between the second approach section and the second bearing section is in the range of 10° to 20°, said drawing of the pipe being in a direction where the pipe moves from the approach section to the bearing section of both the plug and die unit.

2. A method as defined in claim 1, wherein the approach angle of the die is set to 60° to 70°.

3. A method as defined in claim 1, wherein the approach angle of the plug is set to 13° to 15°.

4. A method as defined in claim 1, wherein the second bearing section has a length of 15 to 40 mm.

5. A method as defined in claim 1, wherein the second bearing section has a length of 0.5 to 3.0 mm.

6. A method as defined in claim 1, wherein the plug is provided with a stem for fixing the same in the die.

* * * * *